US006286296B1

(12) United States Patent
Aquillon

(10) Patent No.: US 6,286,296 B1
(45) Date of Patent: Sep. 11, 2001

(54) BRACELET

(75) Inventor: Alain Aquillon, Petit-Lancy (CH)

(73) Assignee: Montres Rolex S.A., Geneva (CH)

( * ) Notice: Subject to any disclaimer, the term of this patent is extended or adjusted under 35 U.S.C. 154(b) by 0 days.

(21) Appl. No.: 09/707,248

(22) Filed: Nov. 6, 2000

Related U.S. Application Data

(63) Continuation of application No. PCT/CH99/00191, filed on May 7, 1999.

(30) Foreign Application Priority Data

May 7, 1998 (CH) ..... 1032/98

(51) Int. Cl.[7] ..... F16G 13/00
(52) U.S. Cl. ..... 59/80; 59/82; 63/4
(58) Field of Search ..... 59/78, 80, 82; 63/4

(56) References Cited

U.S. PATENT DOCUMENTS

| | | | | |
|---|---|---|---|---|
| 1,751,792 | | 3/1930 | Carlson . | |
| 2,518,163 | | 8/1950 | Megar . | |
| 3,837,163 | * | 9/1974 | Fujimori | 59/80 |
| 5,038,557 | * | 8/1991 | Otsuki et al. | 59/80 |
| 5,154,047 | * | 10/1992 | Takagi | 59/80 |

FOREIGN PATENT DOCUMENTS

| | | |
|---|---|---|
| 655 836 | 5/1986 | (CH) . |
| 669 316 | 3/1989 | (CH) . |
| 36 03 850 | 8/1987 | (DE) . |
| 0 146 094 | 6/1985 | (EP) . |
| 2 599 601 | 12/1987 | (FR) . |
| 2 742 638 | 6/1997 | (FR) . |

* cited by examiner

*Primary Examiner*—David Jones
(74) *Attorney, Agent, or Firm*—Henderson & Sturm LLP

(57) ABSTRACT

The invention concerns a bracelet comprising mutually connected links articulated through invisible pivot pins, the links are produced by moulding and the bracelet is mounted by mutually connecting the links by interlocking the pivot pins arranged on one of the links directly into the next link corresponding openings.

4 Claims, 3 Drawing Sheets

BRACELET

CROSS-REFERENCE TO RELATED APPLICATIONS

This application is a continuation of PCT/CH99/00191 filed May 7,1999.

STATEMENT REGARDING FEDERALLY SPONSORED RESEARCH OR DEVELOPMENT

Not Applicable.

BACKGROUND OF THE INVENTION

1. Field of the Invention

The present invention relates to a bracelet with articulated links comprising longitudinally offset elements which interpenetrate one another, connected by pivot members, designed to engage in transversely aligned housings formed through said interpenetrating elements.

2. Description of the Prior Art

DE-A-36 03 850 has already proposed the connecting of articulated links of a bracelet of the aforementioned type by articulation pegs housed partially in the housing of the longitudinally projecting part of one link and pushed out of this housing by a spring, thus engaging the articulation peg in an adjacent housing that opens into the adjacent faces of two offset lateral parts of the adjacent link, which are located one on each side of said longitudinally projecting part. These pegs slide freely in their housing and can be ejected therefrom by the force exerted by the spring so that an arrangement such as this makes the links tricky to fix together because there is a risk that the pivot pegs will be thrown out while they are engaging in the nearby housing of the adjacent link.

U.S. Pat. Nos. 2,518,163 and 1,751,792 have also proposed invisible articulations between links, but these relate, one of them, to hollow two-part links assembled after the introduction of the pivot pin which is thus trapped, and the other, to a link obtained by bending a sheet of metal, two tabs being bent around the pivot pin. In neither instance are the links machined from solid.

BRIEF SUMMARY OF THE INVENTION

In the preferred embodiment of the bracelet of the present invention, each link of the bracelet has a first face and a second face, first and second lateral parts, and a central part which is offset in the longitudinal direction of the bracelet. The offset central part of each link receives the offset central part of the next link adjacently disposed thereto. Each link includes a pair of three housings or apertures. The first pair of housings are oriented substantially transverse to the longitudinal direction of the bracelet and open onto the second face of the offset central part. The second pair of housings are oriented substantially transverse to the longitudinal direction of the bracelet and open onto the first face of the offset central part. The third pair of housings are in communication with the pair of first housings and are oriented substantially in the longitudinal direction of the bracelet and open onto the first face of the offset central part. The links are pivotally connected with a pivot peg having a conical first end and a second end. The first end of the pivot peg is received in the first housings and at least partially projects into third housing. The second end of the pivot peg is received in the corresponding second housing of the adjacently disposed link. A push peg having a conical end is received in the third housing, whereby when the push peg is pushed into the third housing the conical end of the push peg contacts the conical end of the pivot peg and forces the pivot peg transversely outward into the corresponding second housing in the adjacently disposed link. When the push peg is pushed into its locked position within the third housing, the conical end of the pivot peg abuts the side of the push peg thus locking the pivot peg in position.

The object of the present invention is to allow the articulating of links which are easy to manufacture and to assemble. The bracelet thus obtained may be compact and thin and have an attractive esthetic appearance.

This objective is achieved by virtue of the subject of the invention as defined by the claims.

BRIEF DESCRIPTION OF THE SEVERAL VIEWS OF THE DRAWINGS

One embodiment of the invention will be described. This embodiment is illustrated diagrammatically and by way of example by the appended drawing, in which.

DETAILED DESCRIPTION OF THE INVENTION

The bracelet according to the invention comprises links 1,1',1" joined together in an articulated fashion via pivot pins 2,2'. The pivot pins are invisible from the outside. As a preference, the bracelet is very flat and thin, thus representing a particularly esthetic and desirable appearance.

One embodiment of a bracelet is shown by way of example. FIGS. 1*a* to 3*b* show a bracelet with links joined together by pivot pins, 2,2', one end 2*a,* 2'*a* of which is cone-shaped. The person skilled in the art, with awareness of the invention, may produce other forms of embodiment of pivot pins. As a preference, the pivot pins are truly invisible from the outside, which means that by turning the bracelet over and observing it from the top, from the bottom and from the side, the pivot pins cannot be seen.

Highly varied materials may be used to manufacture the bracelet, such as plastics, synthetic fibers, carbon fibers and, of course, metals such as steel, for example steel of the type 316L in the form of metallic powders coated with a thermoplastic binder (MIM), etc. As a preference, the embodiment according to FIGS. 1*a* to 3*b* is made of steel.

As a preference, the links are manufactured by known molding methods applied to the most diverse materials. Such molding methods are economical and quick. Thus, the links can be manufactured with housings 4,4' for the already premolded pivot pins so that all that is required later is for the pivot pins to be introduced into these housings for the links to be premanufactured for the assembly of the bracelet.

As a preference, the bracelet is assembled by joining the links together by clipping the pivot pins thus arranged on one of the links directly into corresponding housings 3,3', 3",3"' in an adjacent link. Assembly in this way is quick and easy.

Figure 1A:
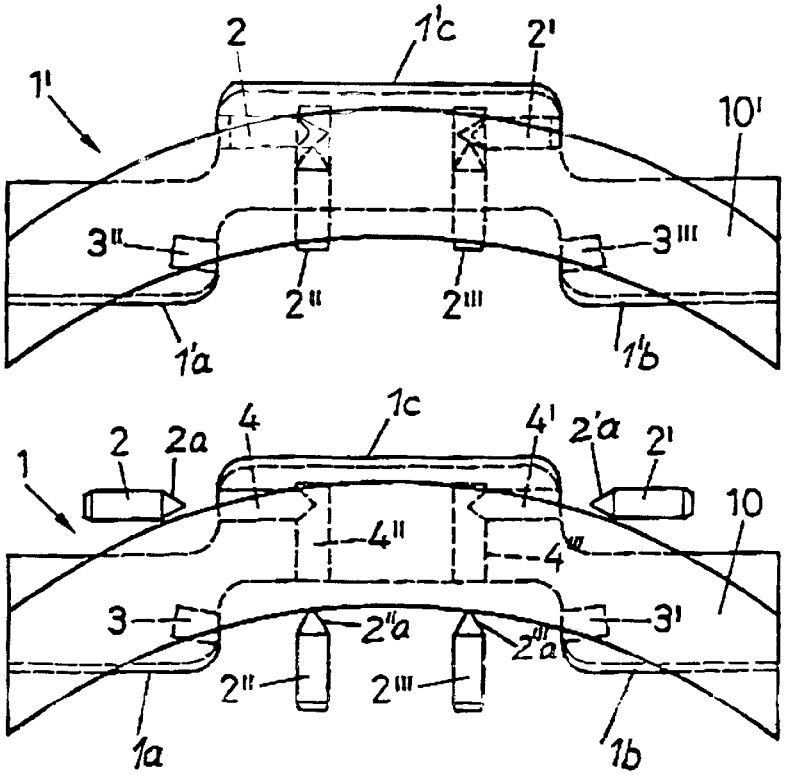
FIGS. 1*a* and 1*b* show a view from above and from the side, partially in section, of a detail of a preferred embodiment of a bracelet according to the invention.
Figure 1B:
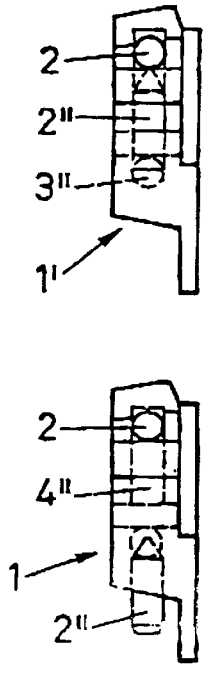
Figure 2A:
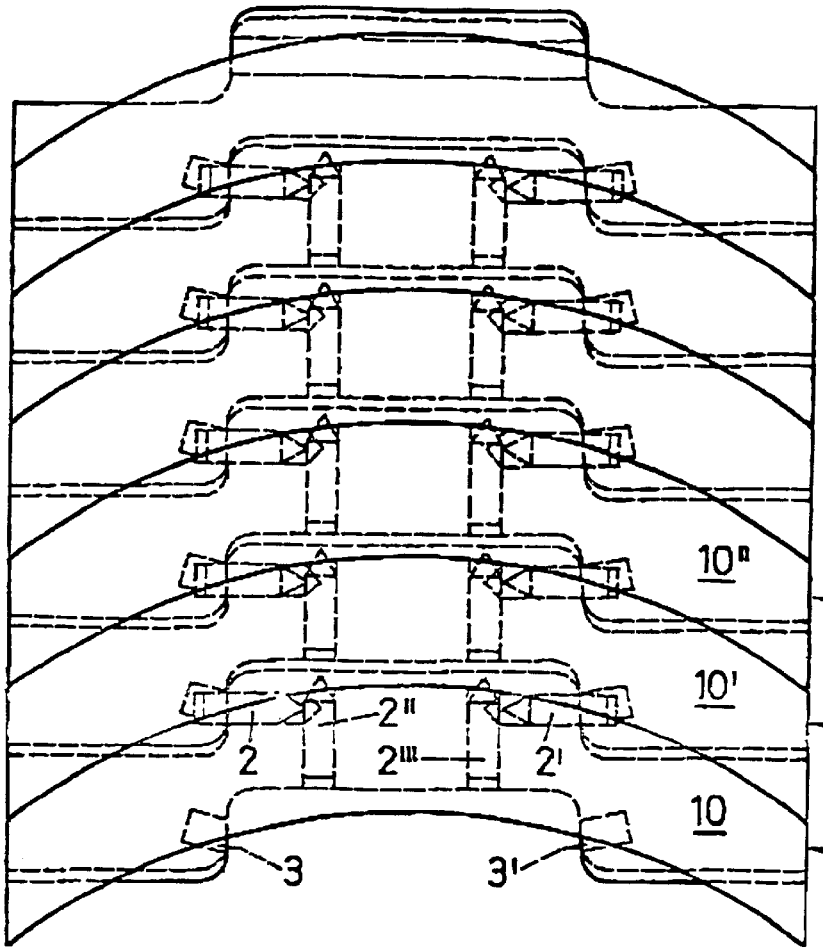
FIGS. 2*a* and 2*b* show a view from above and from the side, partially in section, of another detail of the preferred embodiment of a bracelet according to FIGS. 1*a* and 1*b*.
Figure 2B:
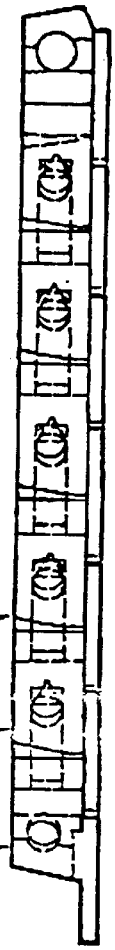

The bracelet illustrated in FIGS. 1–3 comprises links 1,1',1" comprising two lateral parts 1*a,* 1*b* and a central part 1*c* which is offset in the longitudinal direction of the bracelet.

As shown in particular in FIG. 2*a,* the projecting portion of the central part 1*a* of each link 1,1',1" enters the set-back portion of the central part 1*c* of the adjacent link 1,1',1".

Figure 3A:
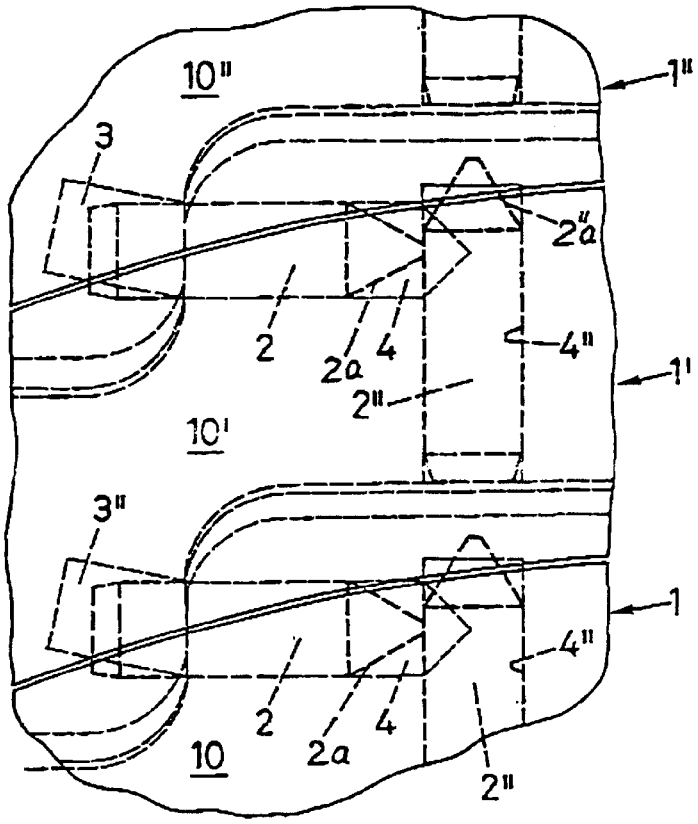
FIGS. 3*a* and 3*b* show a view from above and from the side, partially in section, of another detail of the preferred embodiment of a bracelet according to FIGS. 1*a,* 1*b,* 2*a* and 2*b*.
Figure 3B:
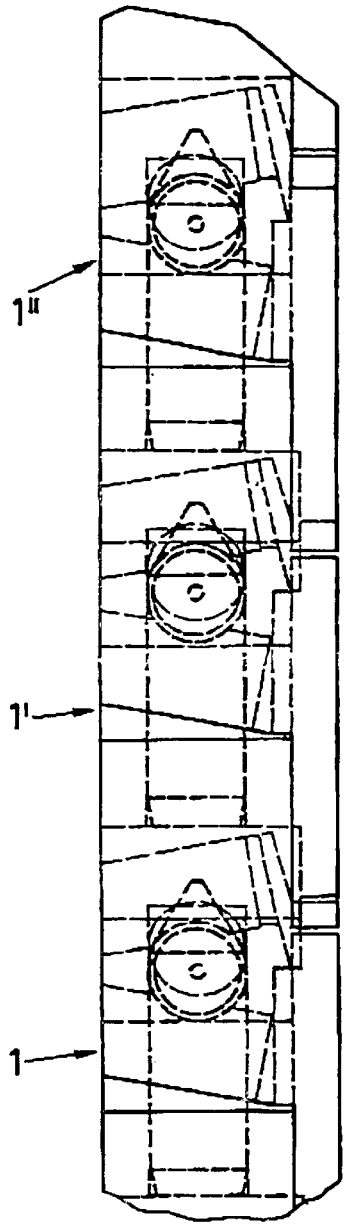

FIG. 3*a* provides a clear understanding of the method of assembly and of articulation of the links 1,1',1" etc. These links are joined and articulated together by pivot pegs 2,2' of which one end 2*a,*2'*a* is conical. These pegs are arranged in roughly transverse and coaxial housings 4,4' formed in the projecting portion of the central part 1*c* of the links 1.

Each transverse housing 4,4' opens onto a lateral face oriented in the longitudinal direction of the bracelet and faces the entrance of a housing 3,3',3" etc. opening into the parallel lateral and adjacent face of a lateral part 1*a,*1*b* of the adjacent link.

The other end of this transverse housing 4,4' opens into a roughly longitudinal housing 4" and 4"' respectively, one end of which opens into the lateral face of the set-back portion of this central part 1*c*.

As FIG. 1*a* shows, two other pegs 2", 2"' are introduced into the longitudinal housings 4", 4"'. One of their ends 2"*a,* 2"'*a* is conical. In this FIG. 1*a,* a link 1 is depicted before the fitting of the pegs 2–2"', while the link 1' is depicted with the pegs 2–2"' introduced into their respective housings 4–4"'. It may be seen that the conical ends of the pivot pegs 2,2' are engaged in the longitudinal housings 4", 4"' and that their other ends do not protrude from the transverse housings 4,4, while the conical ends 2"*a,* 2"'*a* of the pegs 2", 2"' butt against the conical ends 2*a,* 2'*a* of the pivot pegs 2, 2' and project out of their respective housings 4", 4"'.

When the projecting portion of the central part 1*c* of the link 1 of FIG. 1*a* is arranged in the set-back portion of the central part 1'*c* of the adjacent link 1', the openings of the transverse housings 4, 4' face the openings of the housings 3",3"' of the lateral parts 1'*a,*1'*b* of the adjacent link 1' (FIG. 3*a*).

By pushing the pegs 2", 2"' into their respective longitudinal housings 4", 4"', the movements of the conical ends 2"*a,* 2"'*a* of the pegs 2", 2"' cause movements at 90° of the pivot pegs 2, 2' in opposite directions to one another, causing these pivot pegs to protrude from their respective housings so as to make them enter the housings 3",3"' of the adjacent link 1'. To enter these housings, the pivot pegs 2,2' may have a certain amount of clearance in the housings 3",3"'. The ends of the pegs 2,2' can pivot with clearance in these housings 3",3"'.

As shown by FIG. 3*a,* at the end of travel, the pegs 2", 2"' are completely embedded in their respective housings 4", 4"' and the ends of the cones 2*a,*2'*a* of the pivot pegs are pressing against the cylindrical part of the pegs 2", 2"' so that these pegs 2", 2"' prevent the pivot pegs 2, 2' from moving longitudinally, locking them in the position illustrated in FIG. 3*a*.

As a preference, there are four pegs 2–2"' per link. An upper part 10,10',10" of each link covers the pegs 2–2"' and the housings so that they are invisible. The person skilled in the art, with awareness of the present invention, may vary the shape of the upper parts 10,10',10". Thus, he may foresee highly varied shapes such as, for example, squares, half-moons, double half-moons, etc. This assembly by the engagement of pegs 2,2' is irreversible, that is to say that the bracelet cannot be taken apart.

What is claimed is:

1. A bracelet with articulating links comprising:

(a) a plurality of links adjacently connected in a longitudinal direction, each said plurality of links having:

(i) a first face and a second face, (ii) first and second lateral parts and an offset central part, said first face of said offset central part of one of said plurality of links adapted to adjacently receive in said longitudinal direction said second face of said offset central part of another of said plurality of links, (iii) a pair of first housings oriented substantially transverse to said longitudinal direction and opening onto said second face of said offset central part;

(iv) a pair of corresponding second housing oriented substantially transverse to said longitudinal direction and opening onto said first face of said offset central part;

(v) a pair of third housings in communication with said pair of first housings and oriented substantially in said longitudinal direction and opening onto said first face of said offset central part and;

(b) a pivot pin having a first end and a second end, said first end received in one of each of said pair of first housings and at least partially projecting into one of each of said pair of third housings, said second end of said pivot pin received in one of each of said pair of corresponding second housings of one of said links disposed adjacently thereto, thereby pivotally connecting said adjacently disposed links about an axis of articulation;

(c) a push peg received in one of each of said third housings, each said push peg having a surface in contact with said first end of said pivot pin, whereby when said push peg is pushed into said one of each of said pair of third housings said push peg forces said pivot pin transversely outward into said one of each of said pair of corresponding second housings of one of said links disposed adjacently thereto, said push peg thereby preventing said pivot pin from moving within said one of each said pair of first housings and corresponding second housings of said adjacently disposed links.

2. The bracelet according to claim 1, wherein once said push peg is pushed into one of said pair of third housings said surface of said push peg in contact with said pivot pin is substantially perpendicular to said axis of articulation of said adjacently disposed links.

3. The bracelet according to claim 1, wherein said push peg has a length which does not exceed that of said one of said third pair of housings so that, in position, said push peg is completely inside said one of said third pair of housings.

4. The bracelet according to claim 1, wherein each of said plurality of links is formed of a lower part comprising said first and second lateral parts and said offset central part and an upper part, said upper part having an upper surface which differs appreciably from a lower surface of said lower part.

* * * * *